US009568295B2

(12) United States Patent
Lee

(10) Patent No.: US 9,568,295 B2
(45) Date of Patent: Feb. 14, 2017

(54) METHOD AND RELATED DEVICES FOR CARRYING OUT TBM EXCAVATION AND EXPANSION BLASTING USING A BLAST PROTECTOR AND A CART

(76) Inventor: Chan Woo Lee, Seoul (KR)

( * ) Notice: Subject to any disclaimer, the term of this patent is extended or adjusted under 35 U.S.C. 154(b) by 576 days.

(21) Appl. No.: 13/996,348

(22) PCT Filed: Sep. 29, 2011

(86) PCT No.: PCT/KR2011/007195

§ 371 (c)(1),
(2), (4) Date: Jun. 20, 2013

(87) PCT Pub. No.: WO2012/086904

PCT Pub. Date: Jun. 28, 2012

(65) Prior Publication Data

US 2013/0263752 A1 Oct. 10, 2013

(30) Foreign Application Priority Data

Dec. 21, 2010 (KR) ..... 10-2010-0131111

(51) Int. Cl.

| | |
|---|---|
| ***E21D 9/12*** | (2006.01) |
| ***F42D 3/00*** | (2006.01) |
| ***F42D 3/04*** | (2006.01) |
| ***E21D 9/00*** | (2006.01) |
| ***E21D 19/04*** | (2006.01) |

(52) U.S. Cl.

CPC ..... *F42D 3/00* (2013.01); *E21D 9/006* (2013.01); *E21D 9/12* (2013.01); *E21D 19/04* (2013.01)

(58) Field of Classification Search

CPC ..... E21D 9/006; E21D 9/12; F42D 3/00; F42D 3/04

USPC ..... 299/33, 18, 64, 13; 405/296, 141, 142; 102/303

See application file for complete search history.

(56) References Cited

U.S. PATENT DOCUMENTS

| | | | | |
|---|---|---|---|---|
| 877,779 | A * | 1/1908 | Keane | E21C 37/12 299/13 |
| 3,467,436 | A * | 9/1969 | Lockwood | E21D 9/1033 299/31 |
| 2002/0070600 | A1 * | 6/2002 | Ro | E21C 37/16 299/13 |

FOREIGN PATENT DOCUMENTS

| | | | |
|---|---|---|---|
| JP | 06-026297 | A | 2/1994 |
| JP | 07-305588 | A | 11/1995 |
| KR | 201998066739 | | 12/1998 |
| KR | 1020020028404 | A | 4/2002 |
| KR | 100351270 | B1 | 9/2002 |
| KR | 1020100003061 | A | 1/2010 |
| KR | 1020110078408 | A | 7/2011 |

* cited by examiner

*Primary Examiner* — Sunil Singh
(74) *Attorney, Agent, or Firm* — STIP Law Group, LLC

(57) ABSTRACT

The present invention relates to a method and related devices for carrying out TBM excavation and expansion blasting, which uses a blast protector and a cart to expand a pilot tunnel by blasting after the pilot tunnel has been formed; and which specifically includes: a step of forming a pilot tunnel; a step of forming a horizontal or vertical blast hole; a step of installing a blast protector within the pilot tunnel; a step of blasting the upper and lower halves of the pilot tunnel to expand the upper and lower halves; and a step of removing the debris formed during the blasting of the upper and lower halves, by dumping the debris into a cart. Accordingly, the rail and cable are protected from the debris formed during the blasting, and working efficiency is improved.

7 Claims, 11 Drawing Sheets

METHOD AND RELATED DEVICES FOR CARRYING OUT TBM EXCAVATION AND EXPANSION BLASTING USING A BLAST PROTECTOR AND A CART

CROSS-REFERENCE TO RELATED APPLICATION

This application claims the benefit of Korean Patent Application No.10-2010-0131111, filed on Dec. 21, 2010 in the Korean Intellectual Property Office, the disclosure of which is incorporated herein by reference.

TECHNICAL FIELD

The present invention relates to a construction method of TBM excavation and enlargement blasting using a blasting protector and a muck car in order to smoothly perform a tunneling work and to protect a rail and a cable installed at a lower portion of a pilot tunnel in an enlargement blasting process of a periphery of the pilot tunnel after excavating the pilot tunnel.

BACKGROUND ART

In general, in order to reduce a vibration of a base rock and to improve an excavating speed, after first excavating a pilot tunnel using a tunnel boring machine (TBM), a tunneling work is performed with a construction method of enlargement blasting a periphery of the pilot tunnel.

According to such an excavating work, while first excavating a pilot tunnel using the TBM, a rail and a cable are installed at the bottom or a side wall of the excavated pilot tunnel. The rail is installed as a delivery means of a muck car for carrying out, for example mucks, and the cable includes, for example, a high-voltage cable for supplying power of the TBM, a water supply pipe for supplying water, and an air supply pipe for supplying air.

When together or separately performing excavation and enlargement blasting of the pilot tunnel, the rail and the cable are maintained or removed, and at the inside of the pilot tunnel, for enlargement blasting, a charge hole for injecting gunpowder into a base rock is drilled in a longitudinal direction or a transverse direction. As a tool for drilling the charge hole, a drill is used, and a leg drill or a jumbo drill is used according to a spot situation. The enlargement blasting using gunpowder is performed in a form of gradually enlarging from the inside to the outside.

When the enlargement blasting is complete, blasted mucks are put in a dump truck or a muck car and are carried out. Here, because the blasted mucks are stacked on the bottom of the pilot tunnel, the blasted mucks are put on the muck car using an equipment, for example a loader or a backhoe.

According to a TBM excavation and enlargement blasting method, i.e., enlargement blasting method simultaneously during TBM excavation of performing with a rail or a cable maintained, there is a problem that mucks may damage the rail and the cable while being stacked on the bottom of a pilot tunnel. In order to solve such a problem, by disposing the specially designed muck car on the rail at a tunnel face at which enlargement blasting is performed, mucks to be dropped to the ground may be put to the muck car, and in this case, when enlargement blasting is performed, the muck car directly receives an impact and may be damaged and a small muck may be jammed between the pilot tunnel and the muck car and thus it may be difficult to move the muck car.

Further, after the enlargement blasting is performed, until mucks stacked on the ground completely are removed, there is a problem that excavation of a pilot tunnel using the TBM is stopped. That is, while mucks are stacked on the ground by enlargement blasting, because the mucks completely block a passage, an excavation work of the pilot tunnel and a work of drilling a transverse charge hole are stopped.

DISCLOSURE

Technical Problem

The present invention is made to overcome the above mentioned problems, and it is an object of the present invention to provide a construction method of TBM excavation and enlargement blasting using a blasting protector and a muck car in order to completely protect a rail and a cable installed in a lower portion of a pilot tunnel from mucks by enlargement blasting.

Another object of the present invention is to provide a construction method of TBM excavation and enlargement blasting using a blasting protector and a muck car in order to smoothly go in and out to a tunnel face of TBM and movement of a muck car through a lower portion of the pilot tunnel even after enlargement blasting is performed.

Another object of the present invention is to provide a construction method of TBM excavation and enlargement blasting using a blasting protector and a muck car in order to conveniently and smoothly perform carrying of mucks generated by enlargement blasting.

Technical Solution

To achieve the above objects, there is provided a construction method of TBM excavation and enlargement blasting using a blasting protector and a muck car, the construction method including: excavating a pilot tunnel using a tunnel boring machine (TBM); drilling a transverse or longitudinal charge hole on an upper half section of the pilot tunnel; connecting and installing a plurality of blasting protectors that partition the upper half section and a lower half section at the front and the rear at the inside of the pilot tunnel; enlargement blasting the upper half section of the pilot tunnel using the charge hole; and loading and carrying mucks stacked on the upper blasting protector by the enlargement blasting in a muck car moving to lower space of the upper blasting protector.

A rubber cover plate may be installed to cover a cable installed at the bottom of the pilot tunnel.

By moving the muck car to lower space between the upper blasting protector on which the mucks are stacked and the upper blasting protector on which the mucks are removed and by moving the upper blasting protector on which the mucks are removed, the two blasting protectors may be spread and the mucks may be loaded in the muck car between the two spread blasting protectors and carried out.

The construction method may further include: moving the upper blasting protector on which the mucks are removed; installing a lower blasting protector for protecting a rail or a cable installed at the bottom of the pilot tunnel; drilling a longitudinal charge hole at both sides of the lower half section of the pilot tunnel; enlargement blasting the lower half section of the pilot tunnel using the charge hole; and loading and carrying mucks stacked on the lower blasting protector by the enlargement blasting in the muck car.

To achieve the above objects, there is further provided a blasting protector for together or separately performing TBM excavation and enlargement blasting, the blasting protector including: a hydraulic support formed in an arch type plate form to partition the inside of the pilot tunnel into an upper half section and a lower half section by installing at the inside of a pilot tunnel excavated by a TBM and installed in both side end portions close contacting with an inner surface of the pilot tunnel; and a hydraulic foldable support for mounting on a muck car when moving and installed in a lower portion thereof At an upper portion of both end portions in which the hydraulic support is installed, a variable blade for adjusting a lateral width may be installed.

A rubber blade may be coupled to an end portion of the variable blade.

A support jaw may be formed in a front end portion of the arch type plate form, and at both sides of a rear end portion thereof, a hydraulic extension plate whose end portion is latched and supported by the support jaw while protracting and retracting in a front-rear direction may be installed.

At first and final upper blasting protectors at connection of the upper blasting protector, in order to perform a function of a support jaw of a hydraulic extension plate, another shape of hydraulic support is installed toward a lower side wall of the pilot tunnel.

Advantageous Effects

When enlargement blasting is performed using a TBM excavation and enlargement blasting method using a blasting protector and a muck car of the present invention, by completely preventing damage of a rail and a cable by mucks, a cost can be reduced and safety can be enhanced.

According to a TBM excavation and enlargement blasting method using a blasting protector and a muck car of the present invention, even after enlargement blasting is performed, going in and out to a tunnel face of TBM and movement of a muck car through a lower space of an upper blasting protector are smoothly performed and thus a work of entire steps such as TBM excavation and enlargement blasting of a pilot tunnel and carrying of the mucks can be simultaneously performed and thus a period of works can be reduced.

According to a TBM excavation and enlargement blasting method using a blasting protector and a muck car of the present invention, because mucks stacked on the blasting protector can be simply moved to a muck car disposed under the blasting protector using a backhoe, a carrying work of the mucks can be more conveniently and rapidly performed.

| | |
|---|---|
| 10: pilot tunnel | 11: TBM |
| 12: rail | 13: cable |
| 14: muck car | |
| 20a, 20c, 20b: charge hole | 21: drill |
| 100: upper blasting protector | |
| 110: hydraulic support | 120: hydraulic foldable support |
| 130: variable blade | 140: rubber blade |
| 150: support jaw | 160: hydraulic extension plate |
| 170: another hydraulic support of hydraulic extension plate | 200: rubber cover plate |
| 300: lower blasting protector | 500: prop |

BEST MODES FOR CARRYING OUT THE INVENTION

A construction method of TBM excavation and enlargement blasting using a blasting protector and a muck car according to the present invention, the construction method including:

step of excavating a pilot tunnel using a tunnel boring machine (TBM);

step of drilling a transverse or longitudinal charge hole on an upper half section of the pilot tunnel;

step of connecting and installing a plurality of blasting protectors that partition the upper half section and a lower half section at the front and the rear at the inside of the pilot tunnel;

step of enlargement blasting on the upper half section of the pilot tunnel using the charge hole; and step of loading and carrying mucks stacked on the upper blasting protector by the enlargement blasting in a muck car moving to a lower space of the upper blasting protector.

Further, a blasting protector for TBM excavation and enlargement blasting according to the present invention, the blasting protector including:

a hydraulic support formed in an arch type plate form to partition the inside of the pilot tunnel into an upper half section and a lower half section by installing at the inside of a pilot tunnel excavated by a TBM and installed in both side end portions close contacting with an inner surface of the pilot tunnel; and a hydraulic foldable support for mounting on a muck car when moving and installed in a lower portion thereof.

MODES FOR CARRYING OUT THE INVENTION

An exemplary embodiment of the present invention will be described in detail with reference to the attached drawings.

As shown in FIGS. 1 to 19, an TBM excavation and enlargement blasting method according to an exemplary embodiment of the present invention includes step of excavating a pilot tunnel 10; step of drilling charge holes 20*a*, 20*b*, and 20*c*; step of installing upper and lower blasting protectors 100 and 300 at the inside of the pilot tunnel; step of enlargement blasting upper and lower half sections of the pilot tunnel; and step of loading and carrying mucks stacked by the enlargement blasting in a muck car 13.

Figure 1:
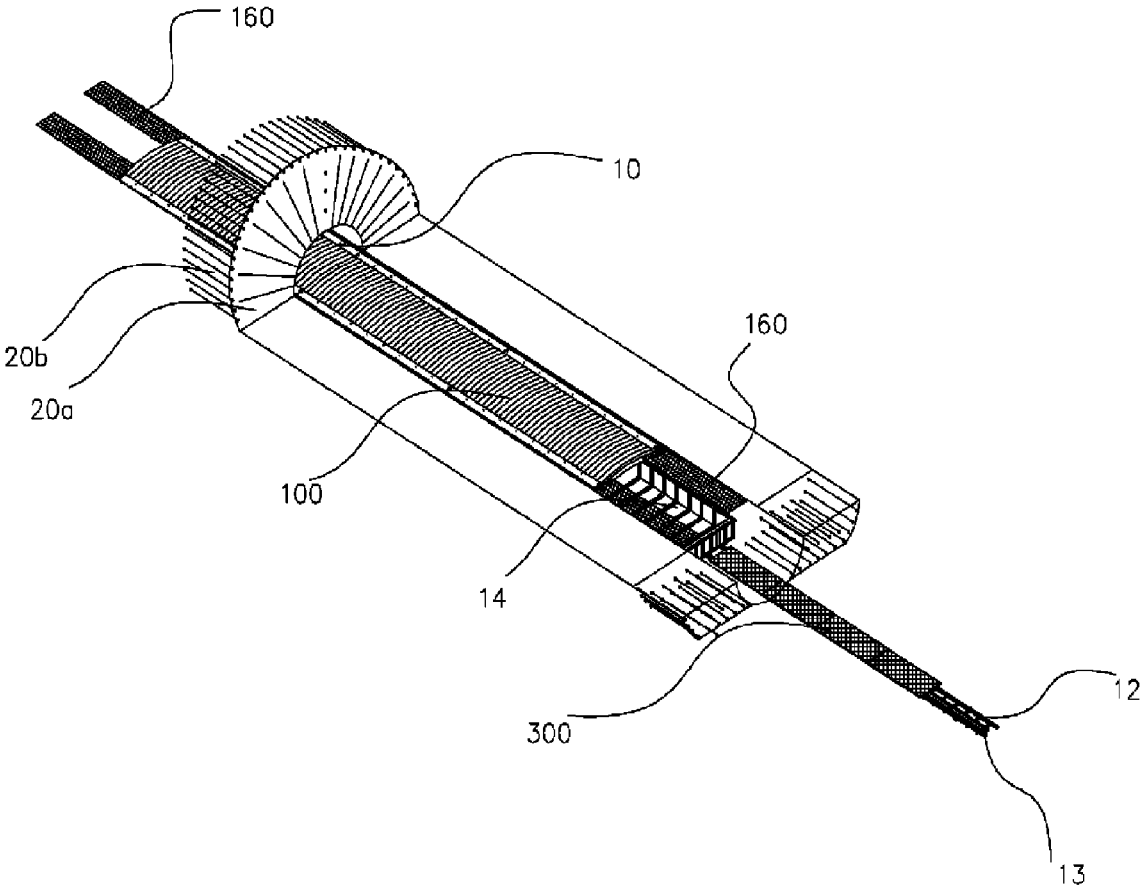
FIG. 1 is a perspective view illustrating a construction state according to an exemplary embodiment of the present invention.
Figure 2:
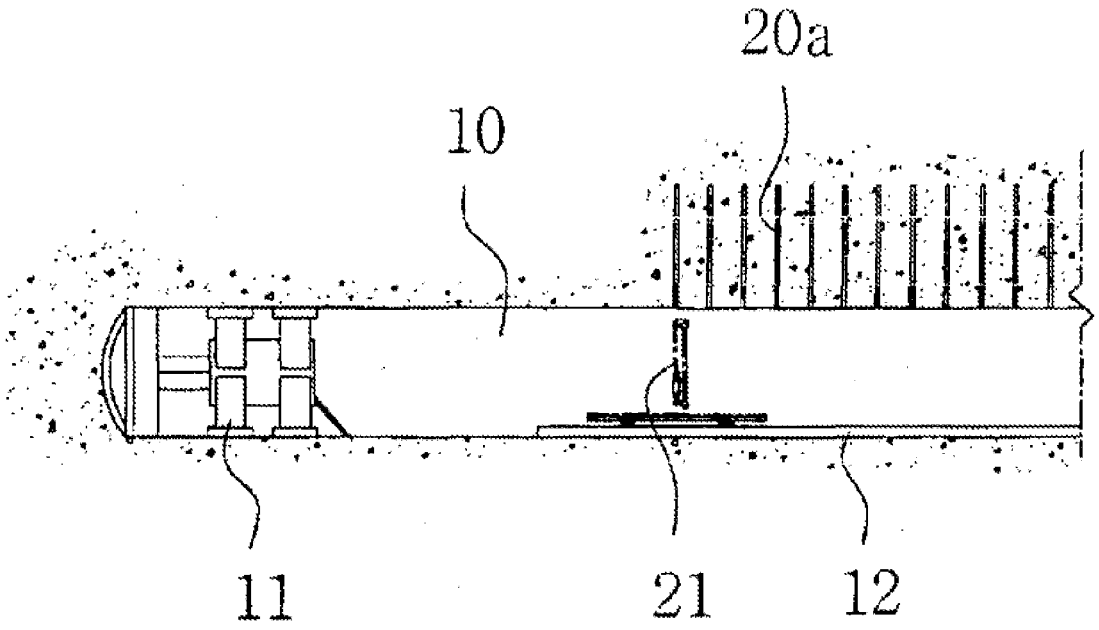
FIG. 2 is a longitudinal cross-sectional view illustrating an excavation work of a pilot tunnel and a drilling work of a transverse charge hole according to an exemplary embodiment of the present invention.
Figure 3:
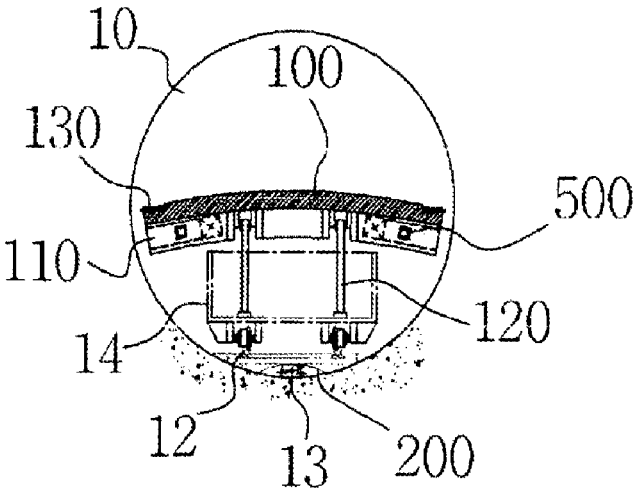
FIG. 3 is a transverse cross-sectional view illustrating an installation work of an upper blasting protector according to an exemplary embodiment of the present invention.
Figure 4:
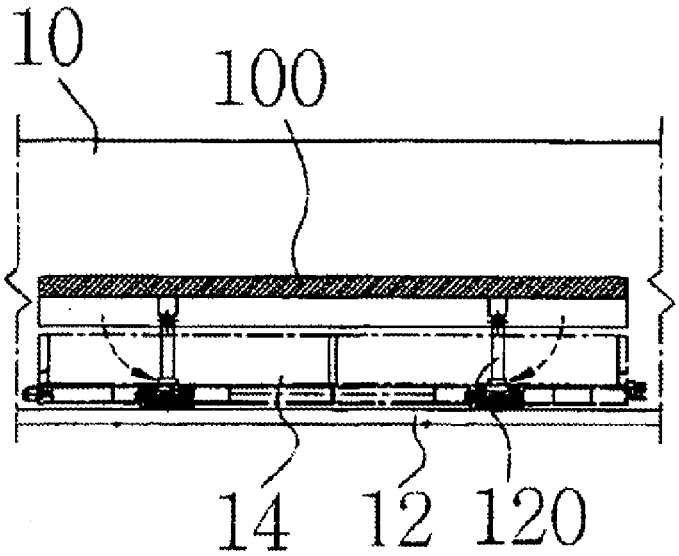
FIG. 4 is a longitudinal cross-sectional view of FIG. 3.
Figure 5:
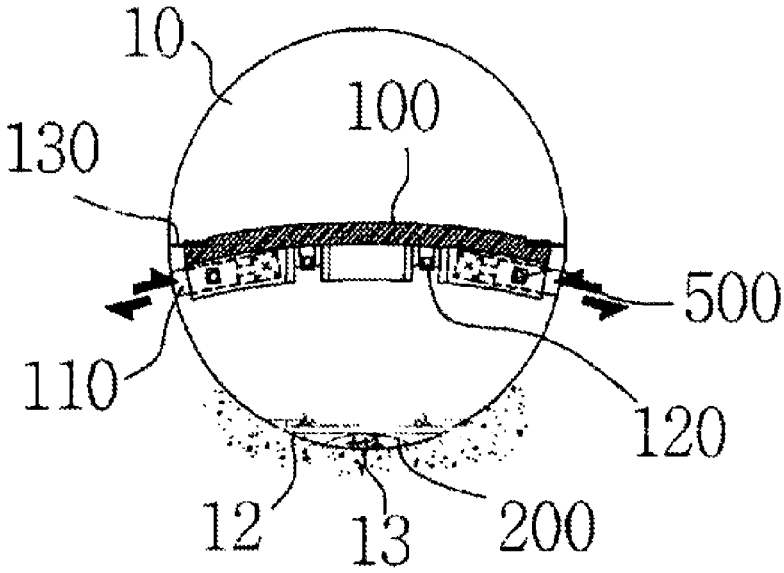
FIG. 5 is a transverse cross-sectional view illustrating an installing state of an upper blasting protector according to an exemplary embodiment of the present invention.
Figures 6A, 6B:
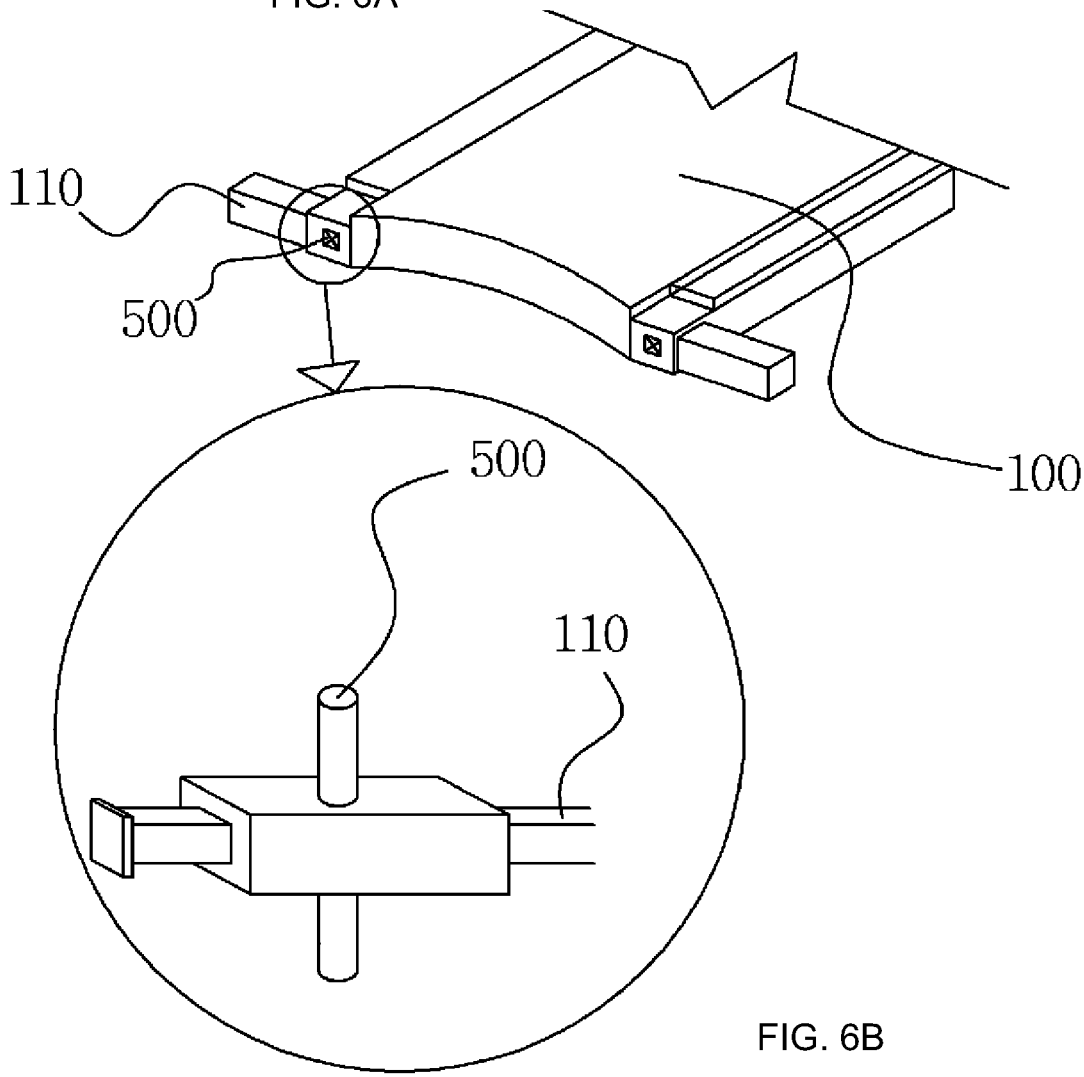
FIG. 6A is a perspective view illustrating a hydraulic support according to an exemplary embodiment of the present invention.
FIG. 6B is a detail view illustrating a prop of FIG. 6A.

Step of excavating the pilot tunnel 10 uses a tunnel boring machine (TBM) 11, as shown in FIG. 2. Step of excavating the pilot tunnel 10 includes step of installing a rail 12 and a cable 13 at the bottom or a side wall. The rail 12 is installed as a delivery means of a muck car 14 for carrying out, for example, mucks. The cable 13 includes a high-voltage cable for supplying power of, for example, the TBM 11, a water pipe for supplying water, and an air supply pipe for supplying air and may be formed in a lower portion of the center between rails, as shown in FIGS. 1 and 3.

Figure 7:
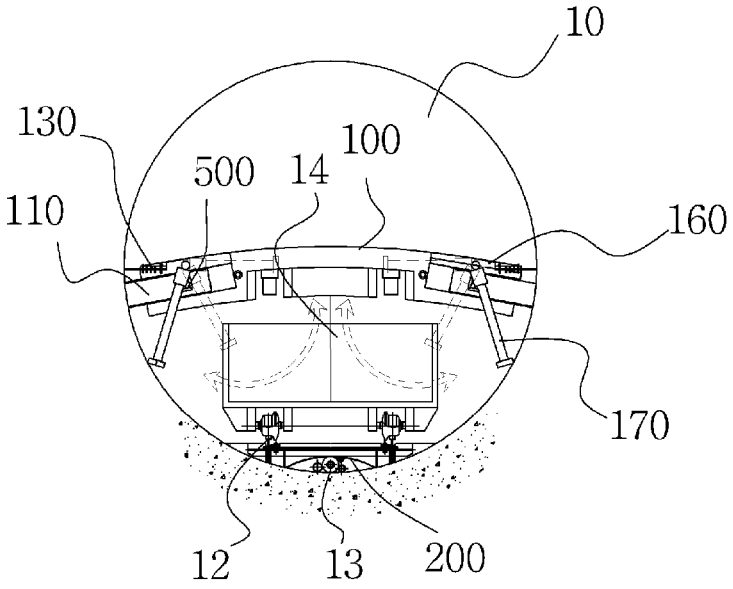
FIG. 7 is a transverse cross-sectional view illustrating a state in which a finish upper blasting protector is installed according to an exemplary embodiment of the present invention.

Step of excavating the pilot tunnel 10 includes step of installing a rubber cover plate 200 for covering the cable 13. The rubber cover plate 200 protects the cable 13 from drop of various equipments or tools as well as mucks and may be formed in, for example, an arch form using a rubber material, as shown in FIG. 7. The cable 13 is doubly or triply protected by the rubber cover plate 200 and the upper and lower blasting protectors 100 and 300 or the muck car 14 through installation of the rubber cover plate 200.

Figure 14:
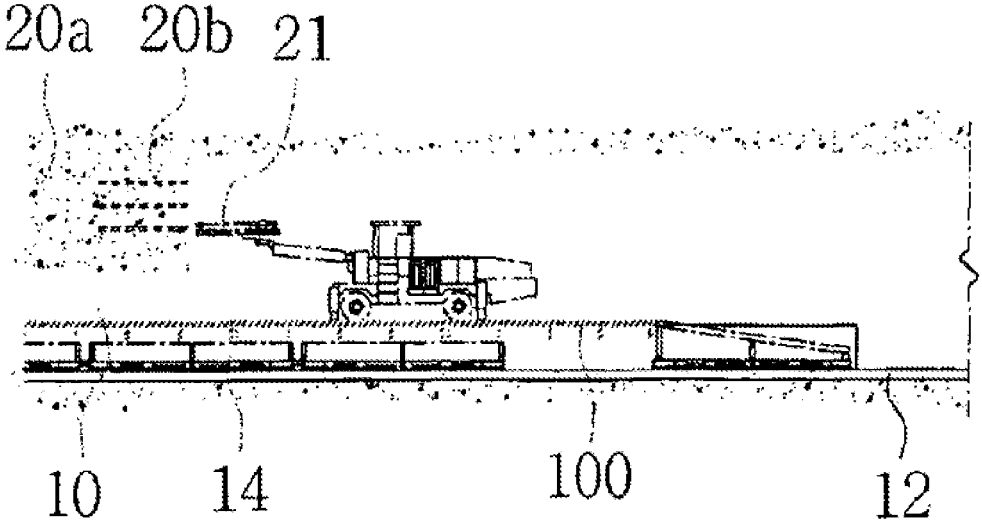
FIG. 14 is a longitudinal cross-sectional view illustrating a drilling work of a longitudinal charge hole on an upper half section according to an exemplary embodiment of the present invention.

Step of drilling transverse or longitudinal charge holes 20*a* and 20*b* on the upper half section of the pilot tunnel 10 is performed using a drill 21, as shown in FIGS. 1, 2, and 14. In this case, before installing the upper blasting protector 100, the transverse charge hole 20*a* should be formed, and the longitudinal charge hole 20*b* may be formed while or after installing the upper blasting protector 100. The charge hole is formed using the drill 21.

The upper blasting protector 100 that partitions an upper half section and a lower half section may be installed using the muck car 14 at the inside of the pilot tunnel 10, as shown in FIGS. 3 to 8. While the upper blasting protector 100 is formed in an arch form to support an impact upon enlargement blasting and a load of mucks, a width between both side end portions should be formed smaller than a diameter of the pilot tunnel 10. Therefore, in order to position both side end portions of the upper blasting protector 100 at the center of the pilot tunnel 10, after the upper blasting protector 100 is loaded on the muck car 14, the upper blasting protector 100 is moved to the inside of the pilot tunnel 10, and in a state in which the upper blasting protector 100 is moved to an installation position, a height of the upper blasting protector 100 mounted on the muck car 14 is lowered and thus both side end portions thereof are fixed and installed in a state latched to both side surfaces of the pilot tunnel 10.

For this purpose, a means for adjusting a height of the upper blasting protector 100 should be installed on the muck car 14 or a lower portion of the upper blasting protector 100. As an example of a means for adjusting a height of the upper blasting protector 100, a hydraulic foldable support 120 installed in a lower portion of the upper blasting protector 100 is illustrated, as shown in FIGS. 3 to 8. The hydraulic foldable support 120 will be described in detail in a description of the upper blasting protector 100.

Figure 15:
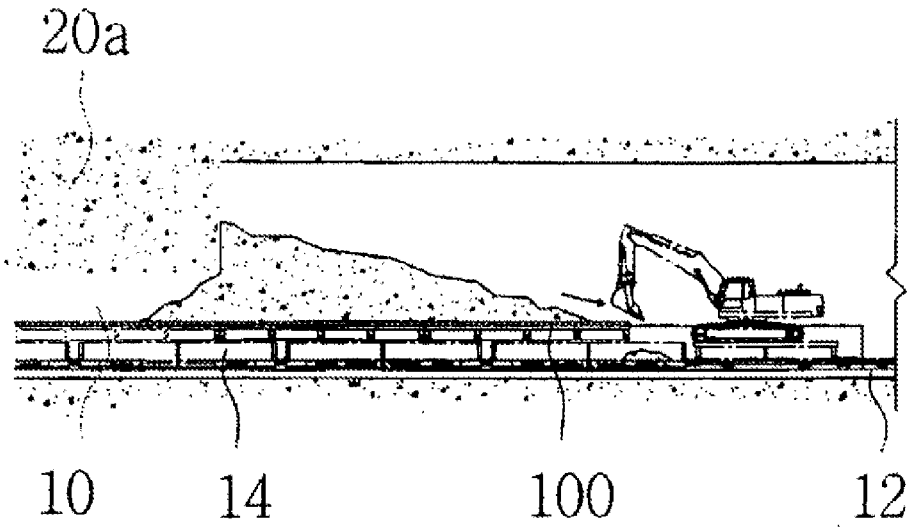
FIG. 15 is a longitudinal cross-sectional view illustrating an enlargement blasting on an upper half section and muck removing work according to an exemplary embodiment of the present invention.

At step of enlargement blasting on the upper half section of the pilot tunnel 10 using the transverse charge hole 20*a* and the longitudinal charge hole 20*c*, blasting should be performed in a form of gradually enlarging from the inside to an outer edge of the pilot tunnel 10. In this case, as shown in FIG. 15, because mucks generated by the enlargement blasting are stacked only on the upper blasting protector 100 and an upper lateral half section of the enlarged tunnel 10, a tunnel face of TBM may be accessible and the muck car 14 may be moved through a passage formed in a lower half section of the pilot tunnel 10.

Figure 16:
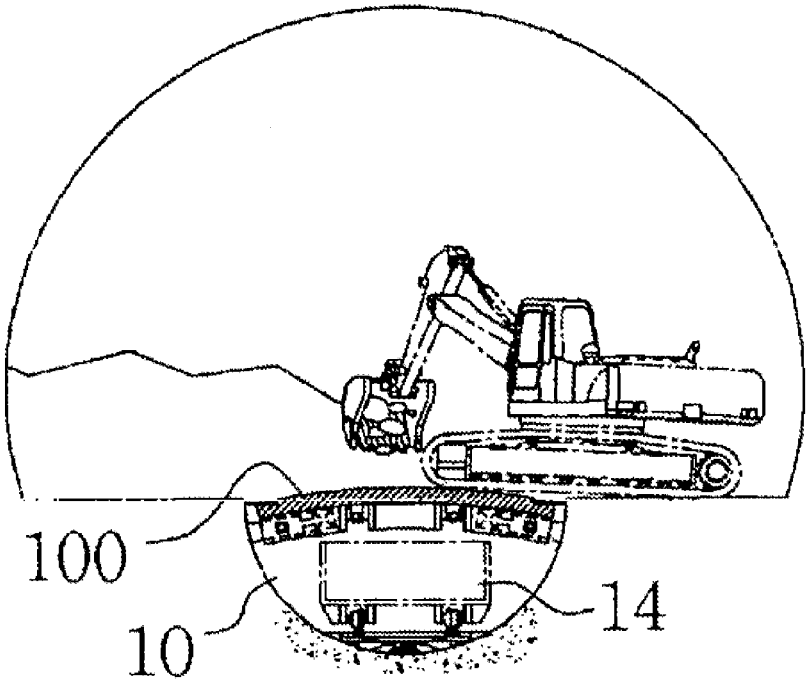
FIG. 16 is a transverse cross-sectional view of FIG. 12.

At step of loading and carrying the mucks stacked on the upper blast protector 100 by the enlargement blasting in the muck car 14, before the enlargement blasting, it is good to move the muck car 14 under the upper blasting protector 100. Therefore, as shown in FIGS. 15 and 16, by taking down the mucks stacked on the upper blasting protector 100 while moving the muck car 14, the mucks are loaded and carried in the muck car 14. In this way, a process of loading mucks stacked on the upper blasting protector 100 in the muck car 14 is more convenient than a conventional process of loading mucks stacked on the ground in the muck car 14 and thus after enlargement blasting, the mucks are more rapidly and smoothly carried out.

Figure 11:
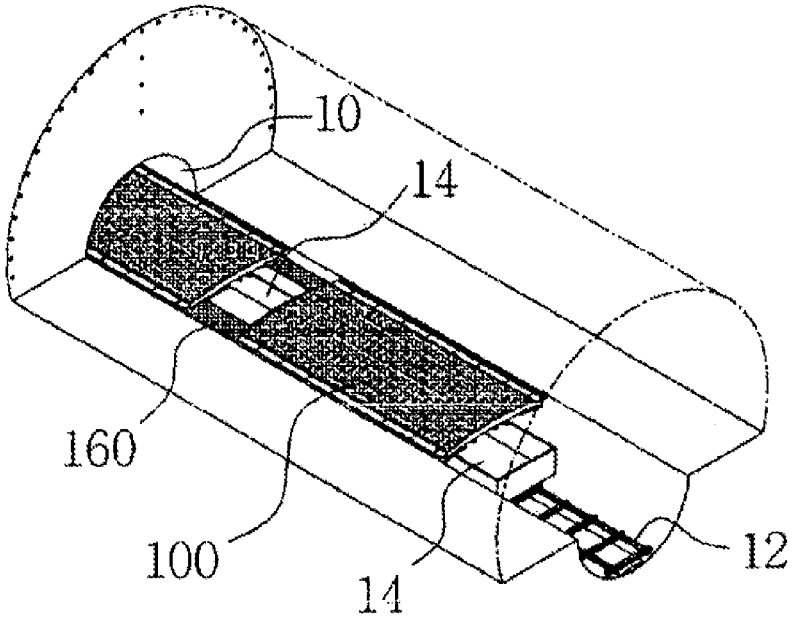
FIG. 11 is a perspective view illustrating an upper blasting protector according to another exemplary embodiment of the present invention.
Figure 12:
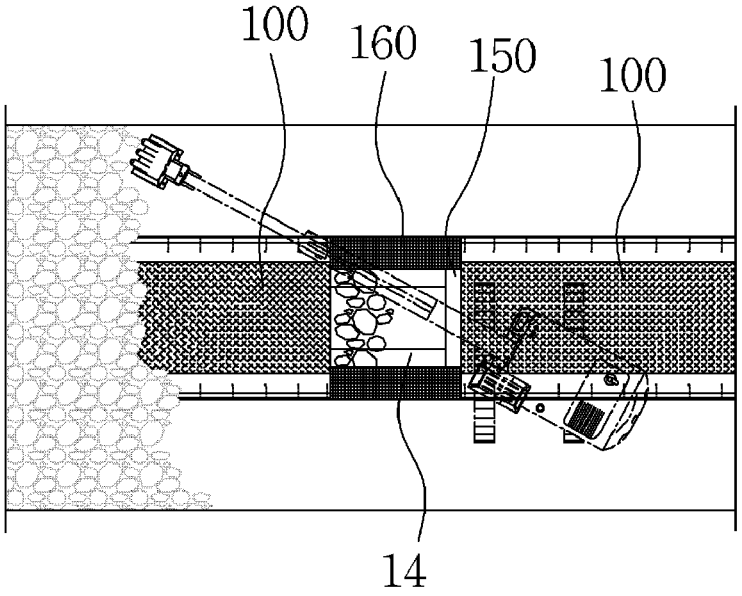
FIG. 12 is a cross-sectional view illustrating a muck removing work using an upper blasting protector according to another exemplary embodiment of the present invention.
Figure 13:
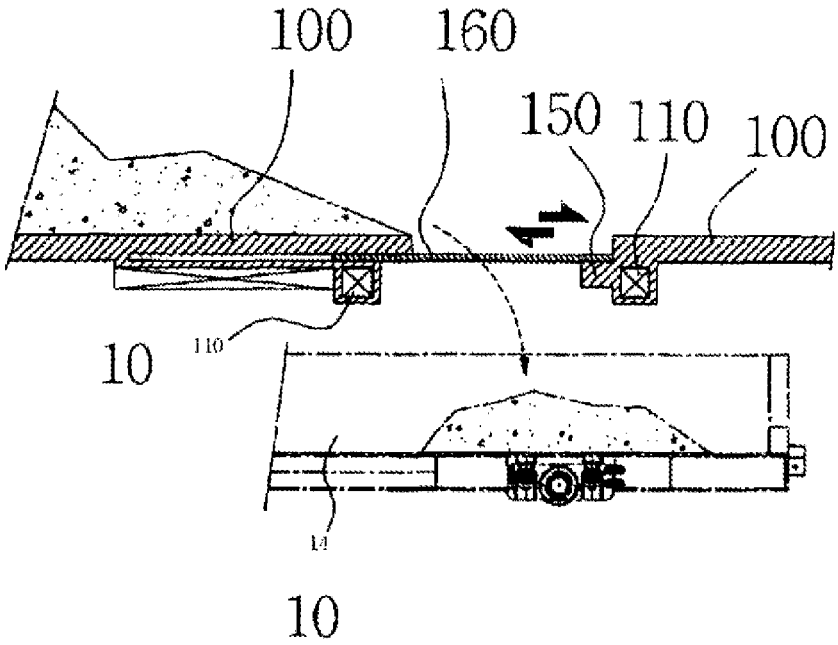
FIG. 13 is a longitudinal cross-sectional view illustrating a recess of an upper blasting protector according to another exemplary embodiment of the present invention.

In a process of loading mucks stacked on the upper blasting protector 100 in the muck car 14, the muck car 14 is moved under between the front and rear upper blasting protector 100, after the front and rear upper blasting protector 100 is spread, the mucks may be loaded in the muck car 14 through the spread gap and be carried out, as shown in FIGS. 11 to 13. In this case, inconvenience that pulls mucks stacked far away on the upper blasting protector 100 to the front side can be reduced. In this case, at both sides of the blasting protector 100, as mucks get out to the outside, the hydraulic extension plate 160 is formed to prevent mucks from dropping at the bottom of the pilot tunnel 10. The hydraulic extension plate 160 will be described in detail later.

Further, an TBM excavation and enlargement blasting method according to an exemplary embodiment of the present invention includes step of moving and installing the upper blasting protector 100; step of installing the lower blasting protector 300 for covering the bottom of the pilot tunnel 10; step of drilling the longitudinal charge hole 20*c* at both sides of a lower half section of the pilot tunnel 10; step of enlargement blasting a lower half section of the pilot tunnel 10 using the charge hole 20*c;* and step of loading and carrying mucks stacked on the lower blasting protector 300 in the muck car 14 by the enlargement blasting.

Step of moving and installing the upper blasting protector 100 is performed in reverse order of installation of the upper blasting protector. That is, after moving the muck car 14 under the upper blasting protector 100, the upper blasting protector 100 is mounted in the muck car and is transported.

At step of installing the lower blasting protector 300 for covering the bottom of the pilot tunnel 10, the lower blasting protector 300 has a configuration different from the upper blasting protector 100, and the lower blasting protector 300 covers a minimum bottom or the rail 12 for moving the muck car 14 to the pilot tunnel 10 and is formed to protect the cable 13. In this case, before installing the lower blasting protector 300, by previously delivering the muck car 14 to the inside of the pilot tunnel 10, the upper blasting protector is moved and installed, and after enlargement blasting, mucks are carried out using the muck car 14.

Figure 17:
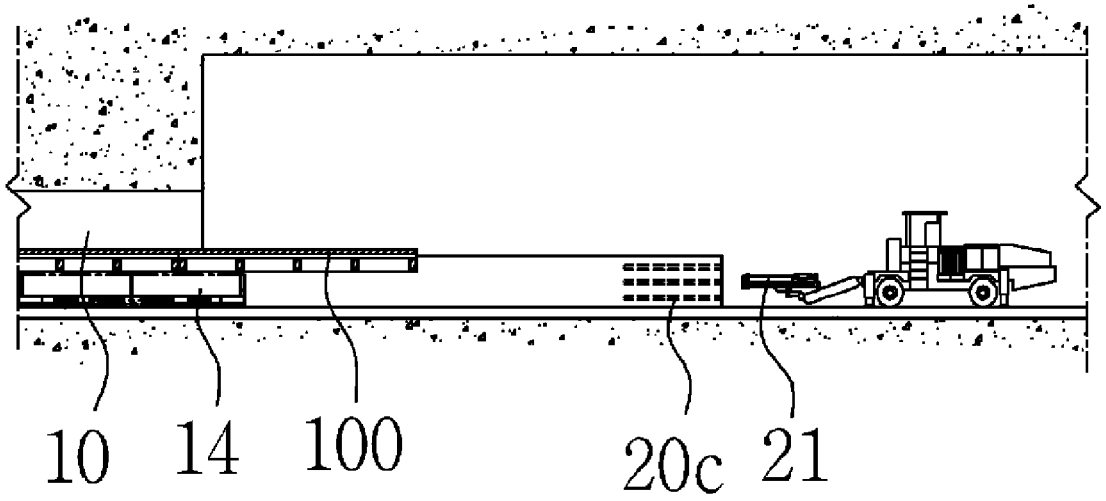
FIG. 17 is a longitudinal cross-sectional view illustrating a drilling work of a longitudinal charge hole on a lower half section according to an exemplary embodiment of the present invention.
Figure 18:
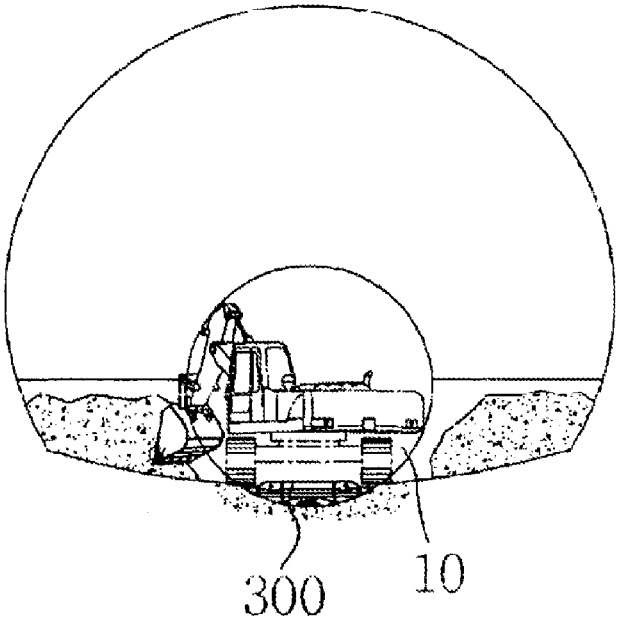
FIG. 18 is a transverse cross-sectional view illustrating an enlargement blasting on a lower half section and muck removing work according to an exemplary embodiment of the present invention.
Figure 19:
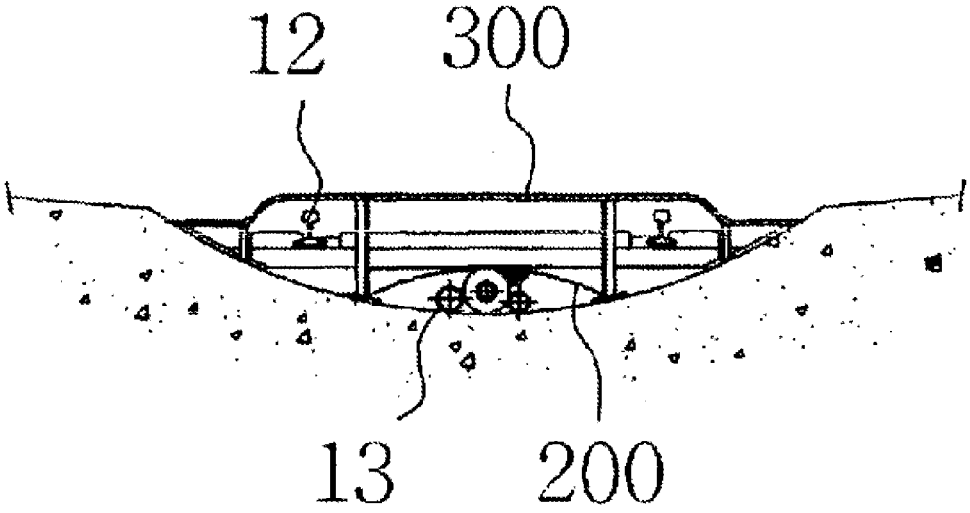
FIG. 19 is a transverse cross-sectional view illustrating an installation state of a lower blasting protector according to an exemplary embodiment of the present invention.

At step of drilling the longitudinal charge hole 20*c* at both sides of a lower half section of the pilot tunnel 10, as shown in FIG. 17, a drilling work is performed using the drill 21, and the maximum drilling height of the longitudinal charge hole 20*c* is larger than a height of the lower blasting protector 300.

At step of performing enlargement blasting of a lower half section of the pilot tunnel 10 using the charge hole 20*c*, in a form of gradually enlarging from the inside to an outer edge of the pilot tunnel 10, blasting should be performed.

Step of loading and carrying mucks stacked on the lower blasting protector 300 in the muck car 14 by the enlargement blasting includes step of loading mucks stacked on the lower blasting protector 300 and the ground in the muck car using a backhoe.

As shown in FIGS. 3 to 10, in a state formed in an arch type plate form, in both side end portions of the upper blasting protector 100, a hydraulic support 110 is installed, and in a lower portion thereof, hydraulic foldable support 120 is installed.

When enlargement blasting is performed, the upper blasting protector 100 bears an impact and a pressure due to heavily dropping mucks, and the upper blasting protector 100 is formed in an arch type plate form to support a load of mucks stacked on the upper blasting protector 100.

The hydraulic support 110 is installed in both side end portions and is installed to incline toward a lower portion. Therefore, the hydraulic support 110 close contacts with both sides of the pilot tunnel 10 to support the blasting protector 100 not to move downward. At both side end portions of the blasting protector 100, a plurality of hydraulic supports 110 are installed in the same gap at the front and the rear. In this case, in order to prevent the hydraulic support from directly receiving a blasting impact, another hydraulic prop 500 is driven in a direction perpendicular to the hydraulic support.

As described above, the hydraulic foldable support 120 is a means for adjusting a height of the upper blasting protector 100, and in a state in which the hydraulic foldable support 120 is mounted in the muck car 14, by spreading the hydraulic foldable support 120, a height of the upper blasting protector 100 is raised, and when the hydraulic foldable support 120 is installed in the pilot tunnel 10, by folding the hydraulic foldable support 120, a height of the upper blasting protector 100 is lowered. As described above, the upper blasting protector 100 may be installed in an intermediate portion of the inside of the pilot tunnel 10 through adjustment of a height of the hydraulic foldable support 120. The hydraulic foldable support 120 is fixed and supported to the bottom of the inside of the muck car.

Figure 8:
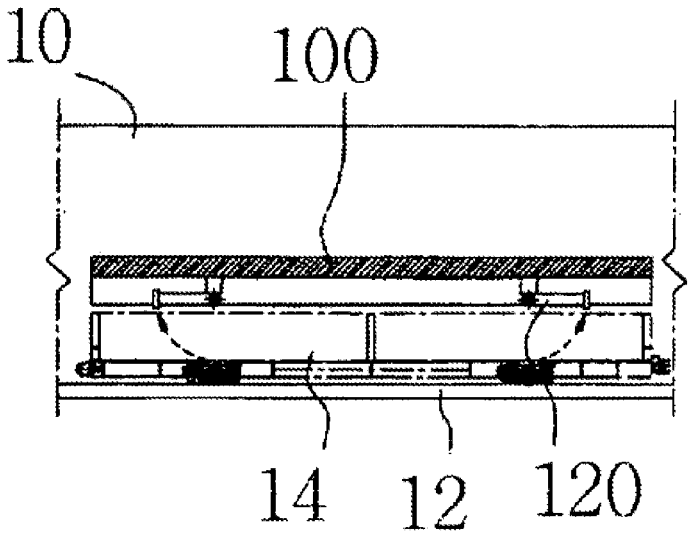
FIG. 8 is a longitudinal cross-sectional view of FIG. 5.
Figure 9:
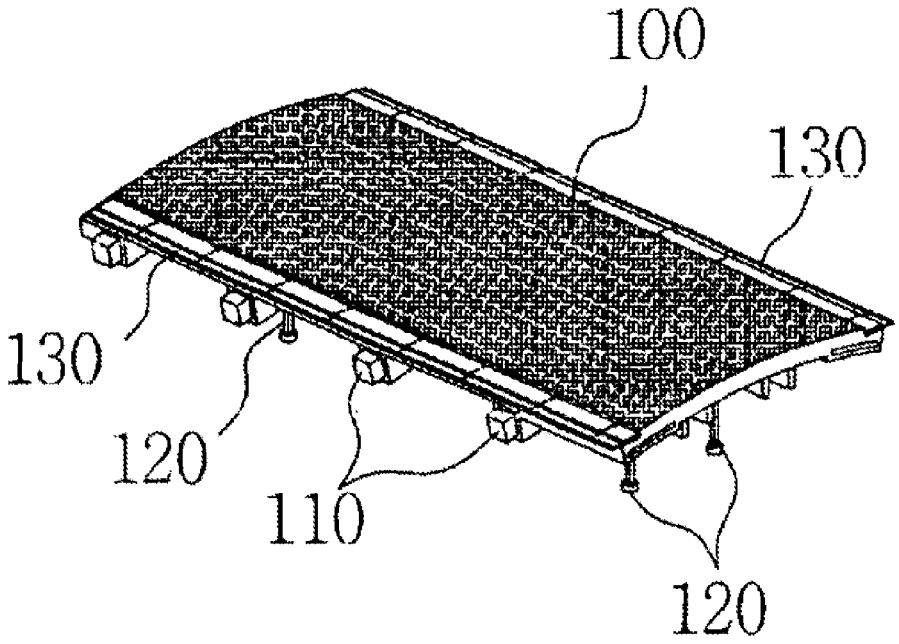
FIG. 9 is a perspective view illustrating an upper blasting protector according to an exemplary embodiment of the present invention.
Figure 10:
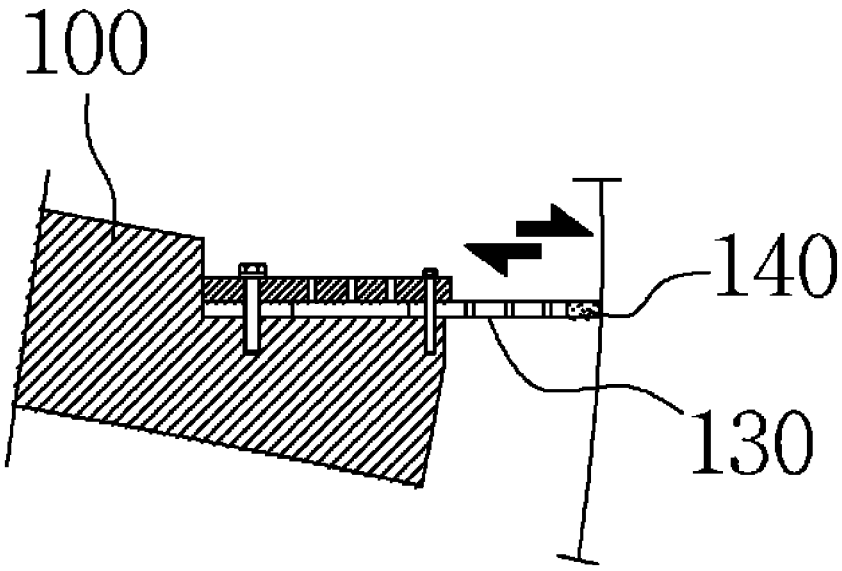
FIG. 10 is a transverse cross-sectional view illustrating a recess of an upper blasting protector according to an exemplary embodiment of the present invention.

At an upper portion of both side end portions in which the hydraulic support 110 is installed, a variable blade 130 for adjusting a lateral width is installed. As shown in FIG. 8, as the variable blade 130 is spread in a lateral direction using a bolt, the variable blade 130 prevents mucks of a small size from dropping to a gap between the pilot tunnel 10 and the upper blasting protector 100. The variable blade 130 can easily cope with to a change of an internal size of the pilot tunnel due to installing shotcrete or H-beam for reinforcement of the pilot tunnel.

By coupling a rubber blade 140 to an end portion of the variable blade 130, close contacting with the pilot tunnel 10 can be further improved.

In a front portion of the upper blasting protector 100, a support jaw 150 installed, as shown in FIGS. 11 to 13, and at both sides of a rear end portion thereof, while protracting and retracting in the front-rear direction, the hydraulic extension plate 160 whose end portion is latched to the support jaw 150 to be supported is installed.

In the upper blasting protector 100 used for finishing, at both sides of a front end portion, the hydraulic extension plate 160 for protracting and retracting in the front-rear direction is installed, and at both sides of a rear end portion, the hydraulic extension plate 160 for protracting and retracting in the front-rear direction is protruded to be connected to an adjacent arch shape plate. Further, at the bottom of the protruded hydraulic extension plate 160 coming from a front end portion of the upper blasting protector 100 used for finishing, another hydraulic support 170 of the hydraulic extension plate is installed to support the protruded hydraulic extension plate 160.

According to the present invention, upon enlargement blasting using the upper blasting protector 100, by preventing damage of the rail 12 and the cable 13 by mucks, a cost is reduced and safety is enhanced.

Further, even after enlargement blasting, going in and out to a tunnel face of TBM and movement of the muck car 14 are smoothly performed through under the upper blasting protector 100 and thus a work of entire steps such as TBM 11 excavation and enlargement blasting of the pilot tunnel 10 and carrying out of mucks can be simultaneously performed and thus a period of works can be reduced.

Further, by simply moving and loading mucks stacked on the upper blasting protector 100 in the muck car 14 disposed under the upper blasting protector using a backhoe, a carrying work of the mucks can be more conveniently and rapidly performed.

The invention claimed is:

1. A construction method using a plurality of blasting protectors, the construction method comprising:

excavating a pilot tunnel using a tunnel boring machine (TBM);

drilling a transverse or longitudinal charge hole on an upper half section of the pilot tunnel;

connecting and installing the plurality of blasting protectors that partition the upper half section and a lower half section at the front and the rear at the inside of the pilot tunnel;

enlargement blasting the upper half section of the pilot tunnel using the transverse or longitudinal charge hole; and loading and carrying mucks stacked on the upper of the plurality of blasting protectors by the enlargement blasting in a muck car moving to a first lower space of one upper blasting protector of the plurality of blasting protectors, wherein the muck car is moved to a second lower space between the upper blasting protector on which the mucks are stacked and the upper blasting protector on which the mucks are removed by moving the upper blasting protector on which the mucks are removed, and wherein two of the plurality of blasting protectors are spread and the loading and carrying of mucks in the muck car is through or between the two spread blasting protectors.

2. The construction method of claim 1, wherein the excavating step comprises a step of installing a cable at the bottom of the pilot tunnel; and a step of installing a rubber cover plate to cover the cable.

3. The construction method of claim 1, further comprising:

moving one upper blasting protector of the plurality of blasting protectors on which the mucks are removed;

installing a lower blasting protector for protecting a rail or a cable installed at the bottom of the pilot tunnel;

drilling a longitudinal charge hole on both sides of the lower half section of the pilot tunnel;

enlargement blasting the lower half section of the pilot tunnel using the longitudinal charge hole; and loading and carrying mucks stacked on the lower blasting protector by the enlargement blasting in the muck car.

4. A plurality of blasting protectors, the plurality of blasting protectors comprising:

an arch type plate for partitioning an inside of a pilot tunnel into an upper half section and a lower half section;

a hydraulic support installed in both side end portions in close contact with an inner surface of the pilot tunnel;

a hydraulic foldable support for mounting on a muck car when moving and installed in a lower portion thereof, a support jaw formed in a front end portion of an arch type plate form; and a hydraulic extension plate whose end portion is latched and supported by the support jaw of the arch type plate by protraction and retraction in a front-rear direction at both sides of a rear end portion of the arch type plate form.

5. The plurality of blasting protectors of claim 4, further comprising:

a variable blade for adjusting a lateral width and installed at an upper portion of side end portions in which the hydraulic support is installed.

6. The plurality of blasting protectors of claim 5, wherein a rubber blade is coupled to an end portion of the variable blade.

7. The plurality of blasting protectors of claim 4, wherein another hydraulic support is installed at the bottom of the hydraulic extension plate protruded from a front end portion of the upper blasting protectors to be used for finishing and supports the protruded hydraulic extension plate.

* * * * *